US006275669B1

(12) United States Patent
Hasegawa

(10) Patent No.: US 6,275,669 B1
(45) Date of Patent: Aug. 14, 2001

(54) THERMAL FIXING DEVICE HAVING ELECTRIC HEATER CONNECTION

(75) Inventor: Makoto Hasegawa, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/520,185

(22) Filed: Mar. 7, 2000

(30) Foreign Application Priority Data

Mar. 31, 1999 (JP) ..... 11-092287

(51) Int. Cl.[7] ..... G03G 15/00
(52) U.S. Cl. ..... 399/90; 399/330; 439/242
(58) Field of Search ..... 399/90, 328–338; 432/60; 219/216; 439/242, 243, 239

(56) References Cited

U.S. PATENT DOCUMENTS 5,974,285 * 10/1999 Tomatsu ..... 399/88

FOREIGN PATENT DOCUMENTS 8-44233 2/1966 (JP) .

* cited by examiner

*Primary Examiner*—Robert Beatty
(74) *Attorney, Agent, or Firm*—Oliff & Berridge, PLC

(57) ABSTRACT

A movable power feeder supports one of terminals of a halogen heater while supplying electric power thereto. The movable power feeder is integrally formed by bending a phosphor bronze thin plate. One of the terminals is secured by use of a screw passing through first and second fastening plates. The first and second fastening plates are supported by a resilient supporting member. Thus, even when the halogen heater generates heat and thermally expands, the terminal shifts while being firmly held by a holding member and stably receiving electric power. Accordingly, the halogen heater is prevented from breaking.

22 Claims, 13 Drawing Sheets

THERMAL FIXING DEVICE HAVING ELECTRIC HEATER CONNECTION

BACKGROUND OF THE INVENTION

1. Field of the Invention

The present invention relates to a fixing device that heats and melts toner adhering to paper in order to fix the toner thereto and form an image.

2. Description of the Related Art

In a conventional thermal fixing device of a laser beam printer, a hollow cylindrical drum, made of aluminum and covered by heat-resistant rubber, is used as a fixing drum, and a halogen heater is disposed inside the drum to heat the fixing drum.

The halogen heater is provided with a supporting member and a power feeding member, separately. The halogen heater is supported on the frame using the supporting member, while electric power is supplied to the halogen heater using the power feeding member through a flexible lead wire extending from the halogen heater. In the fixing device structured as described above, a power feeding member and a heater supporting member must be provided and assembled. Accordingly, the number of components as well as the number of assembling steps are increased and productivity is reduced. Another problem is that the halogen heater is pressed against the frame and secured directly thereto, which may cause the halogen heater to break.

To address the forgoing problems, Japanese Laid-Open Patent Publication No. 8-44233 discloses a fixing device in which a heater, which has, at its opposite ends, high rigidity pin-shaped terminals, is used to allow support of the heater as well as power supply to the heater. In such a heater, if the terminals at the opposite ends are supported while power is supplied thereto, a heater tube can be supported and supplied with power at the same time.

FIG. 12 shows the heater disclosed in the above publication. As shown in FIG. 12, a power feeding member of the heater is a thin metal plate 101, bent into a U-shape, that holds a terminal 104 of a heater tube 103 disposed along a central axis of a fixing roller 102. A power feeding terminal 105 is laminated with the thin metal plate 101, and the power feeding terminal 105 and the thin metal plate 101 are secured to the frame 107 by a screw 106.

The halogen heater heats up to high temperatures quickly when supplied with electric power. Quartz glass surrounding the periphery of the halogen heater has a lower linear thermal expansion coefficient than usual alkaline line glass, and a high stability against drastic temperature changes. However, quartz glass is low in mechanical strength and susceptible to mechanical shock and strain. Therefore, when the terminal 104 of the halogen heater is directly secured to the power feeding terminal 105 of the frame 107, as disclosed in the above publication, the heater is apt to be broken due to mechanical strain caused by the difference in thermal expansion coefficient between the heater and the frame.

In another fixing device, a terminal of a heater is held by a power feeding terminal urged by a spring. In this case, the spring urging force is changed due to the difference in thermal expansion coefficient between the heater and the frame, and electric contact becomes unstable.

In still another fixing device, contact surfaces of a terminal of a heater and a terminal supporting member are made smooth, and the terminal is screw-held to the supporting member slidably under a predetermined pressure. However, polishing and smoothing is difficult. In addition, the terminal of the heater is usually made of tungsten, while the terminal supporting member, that is, an electrode, is made of phosphor bronze based upon this material's resilience and conductivity. The difference in hardness of the metals might cause biting and make sliding impossible.

SUMMARY OF THE INVENTION

An object of the invention, therefore, is to solve the forgoing problems and to provide a cost-effective power feeding member capable of stably supporting a heater tube without causing a breakage and stably supplying electric power to the heater tube.

In a fixing device according to the invention, an electrode of the power feeding member is supported by a supporting member such that the electrode can shift. Accordingly, even when the heater thermally expands, the electrode shifts in correspondence with the expansion. Thus, there is substantially no chance that the heater will break. Further, since terminals of the heater are firmly secured to respective electrodes, the heater can be stably supported by the electrodes and, at the same time, electric power can be stably supplied to the heater without causing poor electric contact. Since the supporting member also serves as the power feeding member, the number of components as well as the number of assembling steps can be reduced, resulting in a reduction of manufacturing cost and an increase of productivity.

According to the invention, the supporting member absorbs mechanical strain caused by the difference in thermal expansion coefficient between the heater and a frame, and thus the heater is reliably prevented from being broken.

In order to absorb mechanical strain, the supporting member is made of a resilient material that can resiliently deform and shift. Such resilience allows the heater to be stably supported at a predetermined position.

Further, the supporting member may be made of a resiliently deformable conductive material and integrally formed with the electrode. When the supporting member is integrally formed with the electrode, one member can serve as a heater supporting member and a power feeding member as well as an electrode supporting member. Accordingly, the number of components and the number of assembling steps are reduced, resulting in a reduction of manufacturing cost and an increase of productivity.

In addition, when the supporting member that supports the electrode is formed by a portion of the frame, the number of components and the number of assembling steps are reduced, resulting in a reduction of manufacturing cost and an increase of productivity.

When a halogen heater using a quartz glass tube is used as the heater, the heater can be stably supported without a breakage, even under generation of a great amount of heat or a quick rise in temperature and, as a result, performance of the fixing device is increased. No breakage occurs because quartz glass has a low linear thermal expansion coefficient and high stability against drastic temperature changes.

When pin-shaped terminals having rigidity capable of supporting the heater are used as the terminals, the heater can be supported stably only by the terminals and no other heater supporting members are required, which contributes to a reduction of manufacturing cost of the printer.

Only one of the terminals of the heater may be arranged to be held by a shiftable electrode, while an electrode for the other terminal is simple in structure. Compared with a heater supported at its both ends by shiftable electrodes, the number of components and the number of assembling steps are reduced, resulting in a reduction of manufacturing cost and an increase of productivity.

BRIEF DESCRIPTION OF THE DRAWINGS

A preferred embodiment of the invention will be described with reference to the following figures wherein.

DETAILED DESCRIPTION OF THE PREFERRED EMBODIMENT

A laser beam printer using a fixing device according to the invention will now be described with reference to the accompanying drawings.

Figure 1:
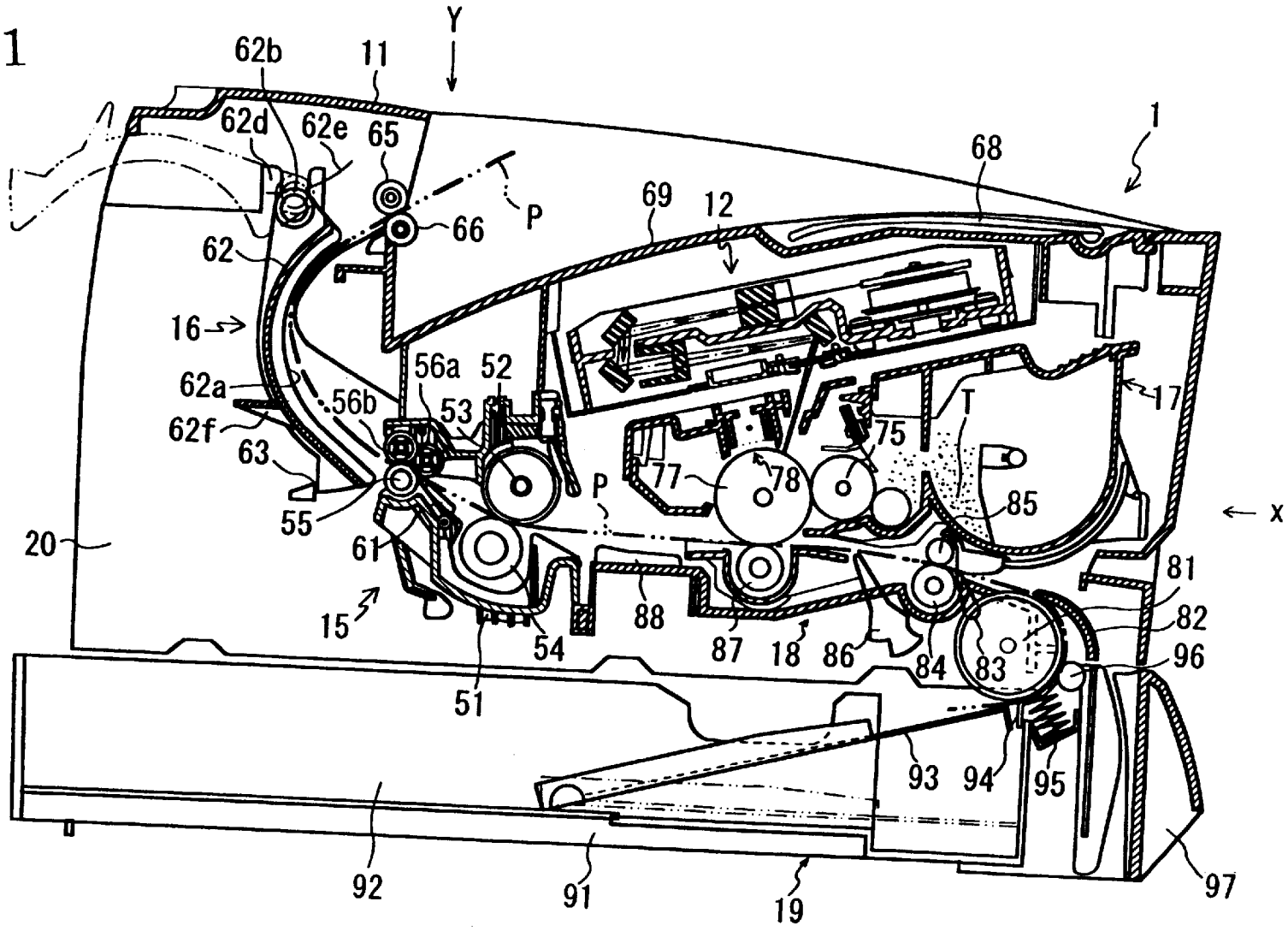
FIG. 1 is a sectional view of a printer as viewed from a side perpendicular to a paper feed direction.

FIG. 1 is a sectional view of a printer 1 as viewed from a side perpendicular to a paper feed direction. The printer 1 is generally shaped to be rectangular parallelepiped by a main frame 11. The right side of FIG. 1 shows the front side of the printer 1 while the front side of FIG. 1 shows the left side of the printer 1. A paper feed cassette 19 accommodating paper P is provided in the lower part of the main frame 11. The paper P accommodated in the paper feed cassette 19 is transported from the front side of the printer I by a transport unit 18. Disposed above the transport unit 18 is a process unit 17, and disposed above the process unit 17 is a laser scanner 12.

In the process unit 17, the laser scanner 12 scans a laser beam LB modulated based on image signals over a photoconductive drum 77 uniformly charged by a scorotron charger 78, and thereby a latent image is formed. The latent image is developed into a toner image using toner T transported by the developing roller 75. The toner image is transferred onto paper P by a transfer roller 87. The paper P with the toner image transferred thereto is transported by the transport unit 18 to a fixing unit 15 disposed on the left of the process unit 17. The fixing unit 15 heats and presses the paper P with the image to fix the toner T thereto. After that, the paper is discharged to a stacker 69 disposed at the rear or top of the printer by a paper discharge unit 16 that can change the paper discharge direction. The printer 1 is generally structured as described above. Each part of the printer 1 will now be described in detail.

As shown in FIG. 1, the paper feed cassette 19 is formed by a generally rectangular parallelepiped box-shaped frame 91 with its upper portion open. The paper feed cassette 19 is similar to a drawer with a handle 97 on its front, and is provided with an accommodating portion 92 where a stack of paper P is accommodated. A swingable paper lifter 93 is pivotally mounted at its base to the central portion of the bottom of the accommodating portion 92. A coil spring (not shown) is disposed beneath the paper lifter 93 to urge the paper lifter 93 upwardly. Thus, the paper lifter 93 always keeps the uppermost sheet of paper P in contact with the paper feed roller 81 at an appropriate pressure either when paper P is stacked high or when paper P is running short and stacked low.

On the front side (on the right side of FIG. 1) of the paper lifter 93, a separation pad 94, made of a material having a high friction coefficient, is disposed facing the paper P. The separation pad 94 is urged by a coil spring 95 disposed beneath so as to press the paper P into contact with the paper feed roller 81. The separation pad 94 feeds only the uppermost sheet to the transport unit 18 while stopping other sheets of paper P by its friction.

The paper feed cassette 19 can be drawn to the front, which facilitates paper supply and removal of jammed paper. When the paper feed cassette 19 is drawn, the separation pad 94 and the driven roller 96 are separated from the paper feed roller 81 to release the paper P pinched therebetween.

The transport unit 18 will now be described. Paper P is fed by the paper feed roller 81 and the driven roller 96 from the paper feed cassette 19 obliquely to the front (to the top right direction in FIG. 1), and the leading edge of the paper P is guided upwardly by a guide 82 and further guided along the guide 82 to the rear. When the paper P is fed by the paper feed roller 81 and the driven roller 96, the leading edge of the paper P pushes down a first paper feed sensor 83 to enter into and abut against a contact portion of a resist roller 84 and the driven roller 85 rotated by the resist roller 84.

The resist roller 84 and the driven roller 85 straighten the paper P. The resist roller 84 is stopped for a predetermined duration after the first paper feed sensor 83 detects the leading edge of the paper P. Since the paper P is continuously fed by the paper feed roller 81 and the driven roller 96, the leading edge of the paper P will abut against, but not enter into, the contact portion of the stopped resist roller 84 and the driven roller 85, and thus the paper P cannot be fed further. However, the paper P still continues to be fed by the paper feed roller 81 and the driven roller 96, the paper P, whose leading edge has been abutting against the resist roller 84 and the driven roller 85, will slack in its intermediate portion due to lack of the guide 82. All this while, the paper P is fed by the paper feed roller 81 and the driven roller 96, and the leading edge of the paper entirely abuts against the contact portion of the resist roller 84 and the driven roller 85. At this time, the leading edge of the paper P becomes accurately parallel with a rotation axis of the resist roller 84. In other words, the paper P becomes straightened. In this condition, when the resist roller 84 is rotated by a control unit 20 in the paper feed direction, the paper P is fed in a straitened and proper orientation.

The paper P straitened by the resist roller 84 is further fed, and its leading edge pushes down a second paper feed sensor 86 and enters into a photoconductive drum 77 and a transfer roller 87. The control unit 20 recognizes the position of the leading edge through the second paper feed sensor 86. The control unit 20 feeds the paper P to its print starting position while leaving a margin.

The laser scanner 12 will now be described.

Figure 3:
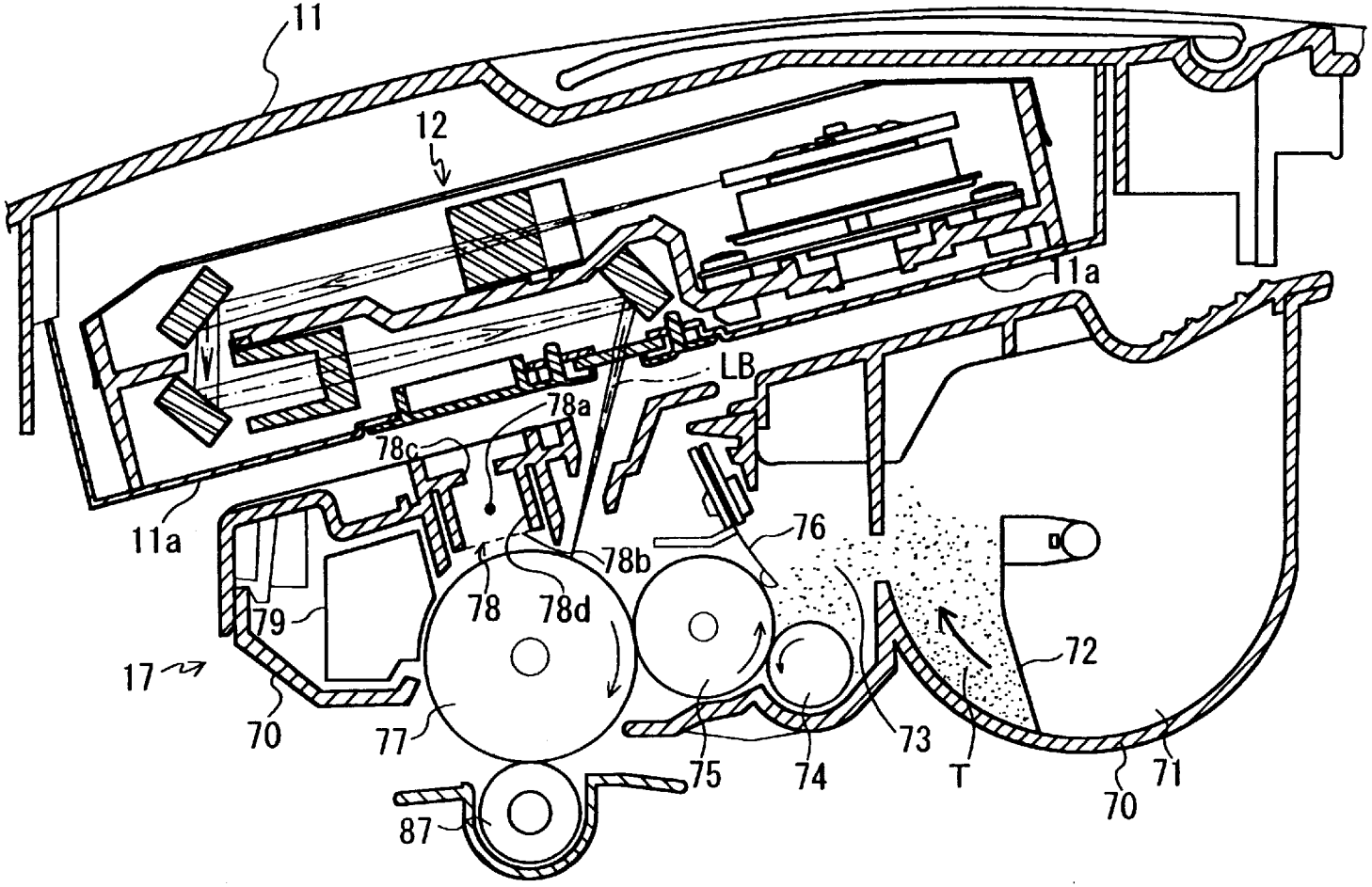
FIG. 3 is a partially enlarged view of a laser scanner unit, a process unit, and a main frame of the printer of FIG. 1.
Figure 4:
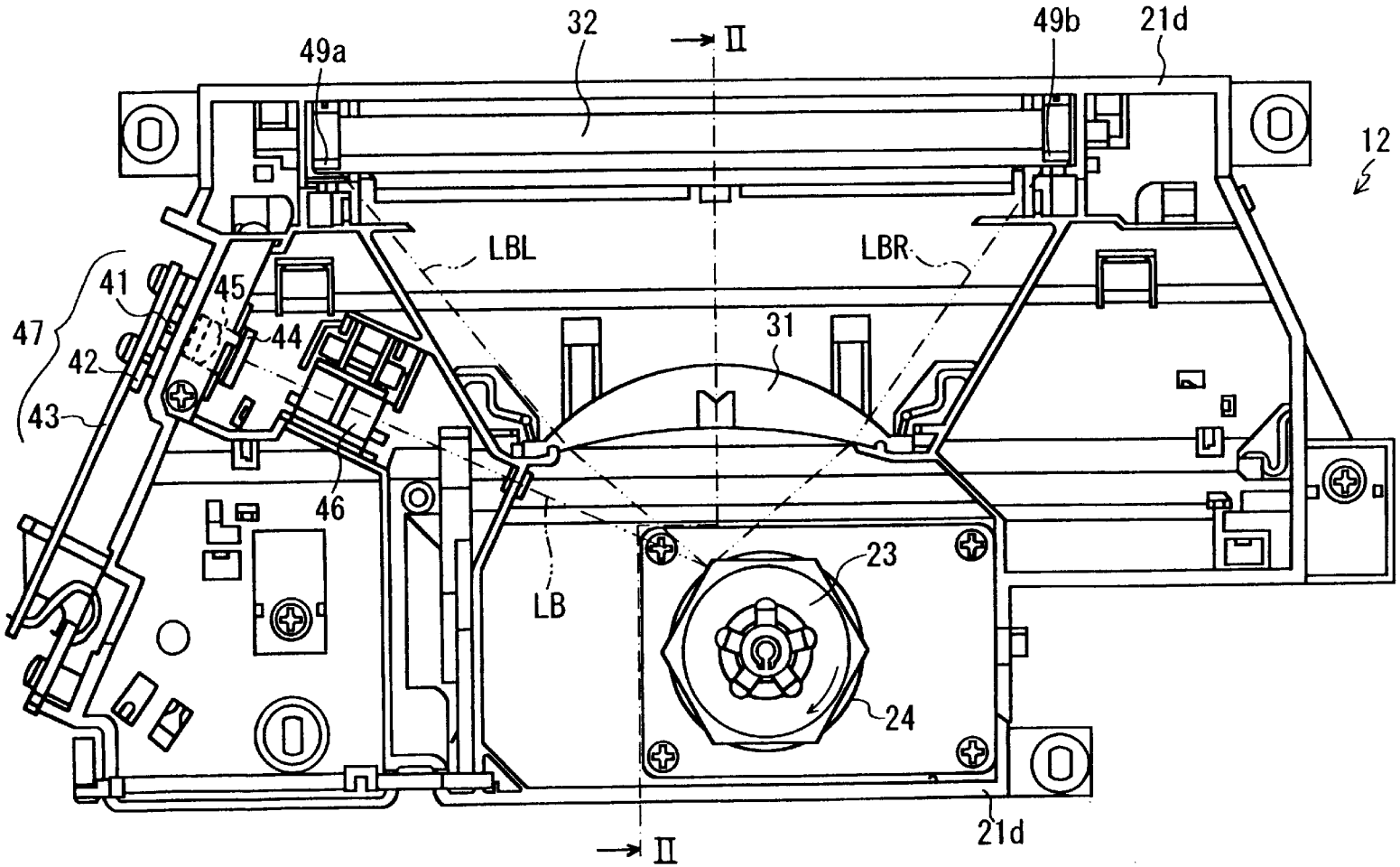
FIG. 4 is a plan view of the laser scanner as removed from the printer and viewed from the top.

FIG. 4 is a plan view of the laser scanner 12 as viewed from the top (from the Y direction in FIG. 1), with its cover 22 removed. As shown in FIG. 4, the laser scanner 12 is surrounded by a side wall 21 d of a supporting member 21. Provided on the upper side (FIG. 2) of the laser scanner 12 are a light emitting unit 47 that includes a laser diode 41, a laser diode holder 42 for holding the laser diode 41, and a board 43 to which the laser diode 41 is connected, a collimator lens 45 that collimates a diffused laser beam emitted from the light emitting unit 47, and a lens cell 44 with a slit regulating the collimated laser beam to a predetermined width. Optical elements that are also provided on the upper side of the laser scanner 12 include a first cylindrical lens 46 that converges the collimated laser beam LB on mirror surfaces of a polygon mirror 23, the polygon mirror 23 that rotates at high speed and sequentially reflects the converged laser beam by six flat mirrors disposed at the sides of a hexagonal prism to change the direction of the laser beam and, a f( lens 31 that scans at constant speed the laser beam LB changed in direction at constant angular speed by the polygon mirror 23 over the surface of the photoconductive drum 77 (FIG. 3), and a first fixed mirror 32 that refracts downwardly the laser beam passing the f( lens 31.

Figure 2:
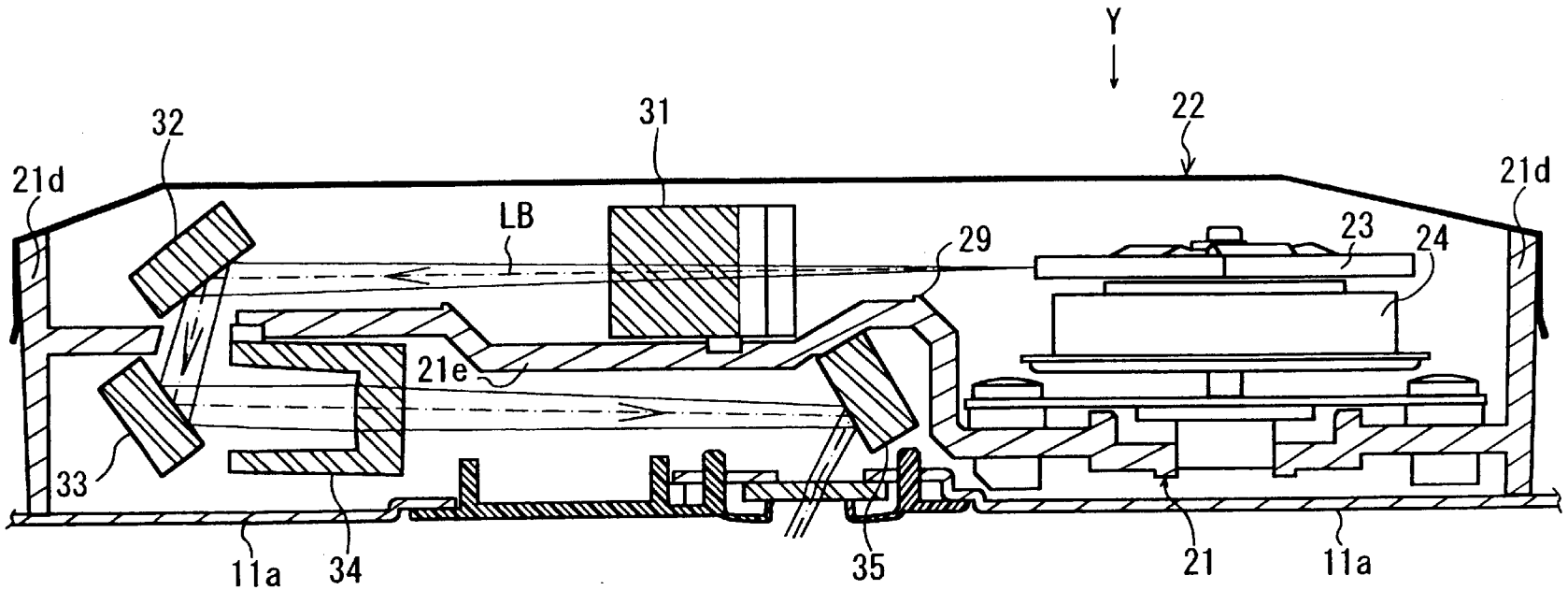
FIG. 2 is a sectional view taken along the line II—II of FIG. 4.

FIG. 2 is a sectional view taken along the line II—II of FIG. 4. As shown in FIG. 2, the laser scanner 12 is separated into the upper and lower sides by a partition 21*e* of the supporting member 21, and optical elements are disposed on both sides. The laser beam reflected by the polygon mirror 23 passes the f( lens 31 and is diffused vertically (in the Y-axis direction) and refracted downwardly by the first fixed mirror 32. Then the laser beam is diffused by a second fixed mirror 33 and travels substantially parallel with, and reverse to, the laser beam traveling on the upper side. Optical elements that are disposed on the lower side include a second fixed mirror 33, a second cylindrical lens 34 that vertically converges the laser beam diffused by the second fixed mirror 33 to form an image on the photoconductive drum 77, and a third fixed mirror 35 that diffuses and reflects the converged laser beams toward the photoconductive drum 77.

As shown in FIG. 3, the laser scanner 12 scans laser beam LB modulated based on image data over the photoconductive drum 77 to form a latent image.

FIG. 3 is a partially enlarged view of the laser scanner 12, the process unit 17, and the main frame 11.

As shown in FIG. 3, the process unit 17 has a frame 70 that accommodates and supports all of the component parts. The frame is roughly divided into a developer chamber 71 and a developing chamber 73. In the developer chamber 71, non-magnetic single component toner T is accommodated and a blade-shaped agitator 72 is supported by a rotating shaft driven by a motor (not shown). Thus, the toner T is constantly supplied, by rotation of the agitator 72, from the developer chamber 71 to the developing chamber 73.

The developing chamber 73 is provided with the photoconductive drum 77, a developing roller 75 disposed at the front of the photoconductive drum 77 and rotating in contact with, and in a reverse direction to, the photoconductive drum 77, and a supply roller 74 disposed at the front of the developing roller 75 and rotating in the same direction as the developing roller 75. The developing chamber 73 is further provided with a paper dust eliminator 79 disposed at the rear of the photoconductive drum 77, a charger 78 disposed above the photoconductive drum 77, and a layer thickness regulating blade 76 in contact with the surface of the developing roller 75.

The supply roller 74 rotates, and presses its spongy surface into contact with, the developing roller 75 to apply toner particles thereto. The layer thickness regulating blade 76 is urged by a predetermined pressure to be in contact with the developing roller 75 and scrapes excessive toner T off the developing roller 75 to make the amount of toner adhering thereto uniform.

The photoconductive drum 77 is driven to rotate in the paper feed direction (clockwise in FIG. 3) and transports the paper P in cooperation with the transfer roller 87. In advance, the paper dust eliminator 79 eliminates paper dust adhered to the photoconductive drum 77. The paper dust eliminator 79 is formed by a brush or an nonwoven wiper and traps paper dust while letting pass the toner remaining on the photoconductive drum 77. The remaining toner, having passed the paper dust eliminator 79, faces the charger 78 by rotation of the photoconductive drum 77.

The charger 78 is provided with a tungsten wire 78*a*, 50–100 $\mu$m in diameter, disposed in parallel with, and away approximately 10 mm from, the photoconductive drum 77. Although the wire 78*a* is covered by an aluminum shield electrode 78*d*, a groove is defined in a portion facing the photoconductive drum 77. This groove receives a grid electrode 78*b* made of several wires or a mesh that is electrically insulated from the shield electrode 78*d*.

On the opposite side of the shield electrode 78*d* from the side facing the photoconductive drum 77, a hole 78*c* extends along the longitudinal direction of the photoconductive drum 77 and opens to the scanner support (main frame) 11. A cleaning member is guided through the hole 78*c*, which pinches and slides along the contaminated wire 78*a*.

The wire 78*a* is connected to a positive pole of a power source (not shown) and subjected to high voltages of 5–10 kv. Positive ions generated through the application of high voltages move to the surface of the photoconductive drum 77, and thereby the surface of the drum 77 is charged. The charging potential can be controlled by biasing the grid electrode 78*b* or by varying the voltage applied to the wire 78*a*. The charger 78 positively charges the surface of the photoconductive drum 77. The scorotron type charger 78 may be replaced by a corotoron type charger without the grid electrode 78*b*. Any other type of charger, for example a type using a brush, may be used as long as it generates corona discharge.

Of the surface of the photoconductive drum 77, portions positively charged by the charger 78 are irradiated with the laser beams LB by the laser scanner 12. The photoconductive drum 77 is formed by an OPC (organic photoconductor), which is relatively low in durability but light and relatively inexpensive. When the surface of the photoconductive drum 77 is irradiated with the laser beam LB, portions irradiated with the laser beam LB become high in conductivity and low in charging potential, and thereby a latent image is formed due to the potential difference. The photoconductive drum 77 may be formed by a photoconductor made of a-Si (amorphous silicon) sensitive to light emitted at high speed and having long-life conductivity, a selenium photoconductor made of Se or Se-alloy, or by a photoconductor made of CdS (cadmium sulphide).

The portions on the photoconductive drum 77 where the latent image is formed make contact with the developing roller 75 to which toner T is applied. The developing roller 75 includes a stainless steel roller shaft and a base material formed around the roller shaft and made of carbon black-dispersed, conductive silicon rubber or urethane rubber. The surface of the roller is coated with fluororesin. The toner T applied to the developing roller 75 is frictionally positively charged by the supply roller 76 and the layer thickness regulating blade.

When the developing roller 75 makes contact with the photoconductive drum 77, the toner T adheres to the portions irradiated with the laser beam LB and charged to a low potential. As a result, the toner T develops the latent image into a visible image. The toner remaining on the photoconductive drum 77 is collected by the developing roller 75. The developed image is transported by rotation of the photoconductive drum 77 to the position facing the paper P nipped by the drum 77 and the transfer roller 87.

The transfer roller 87 is formed by a conductive roller covered by a base material made of carbon black-dispersed, conductive silicon rubber or urethane rubber. The transfer roller 87 is connected to a negative pole of the power source (not shown) and subjected to a voltage. Application of negative voltage to the transfer roller 87 maintains the potential of the paper P negative. The transfer roller 87 is urged toward the photoconductive drum 77 to bring the paper P into contact therewith. The toner image formed on the photoconductive drum 77 is transferred onto the paper P due to the potential difference between the toner and the paper P.

Figure 5:
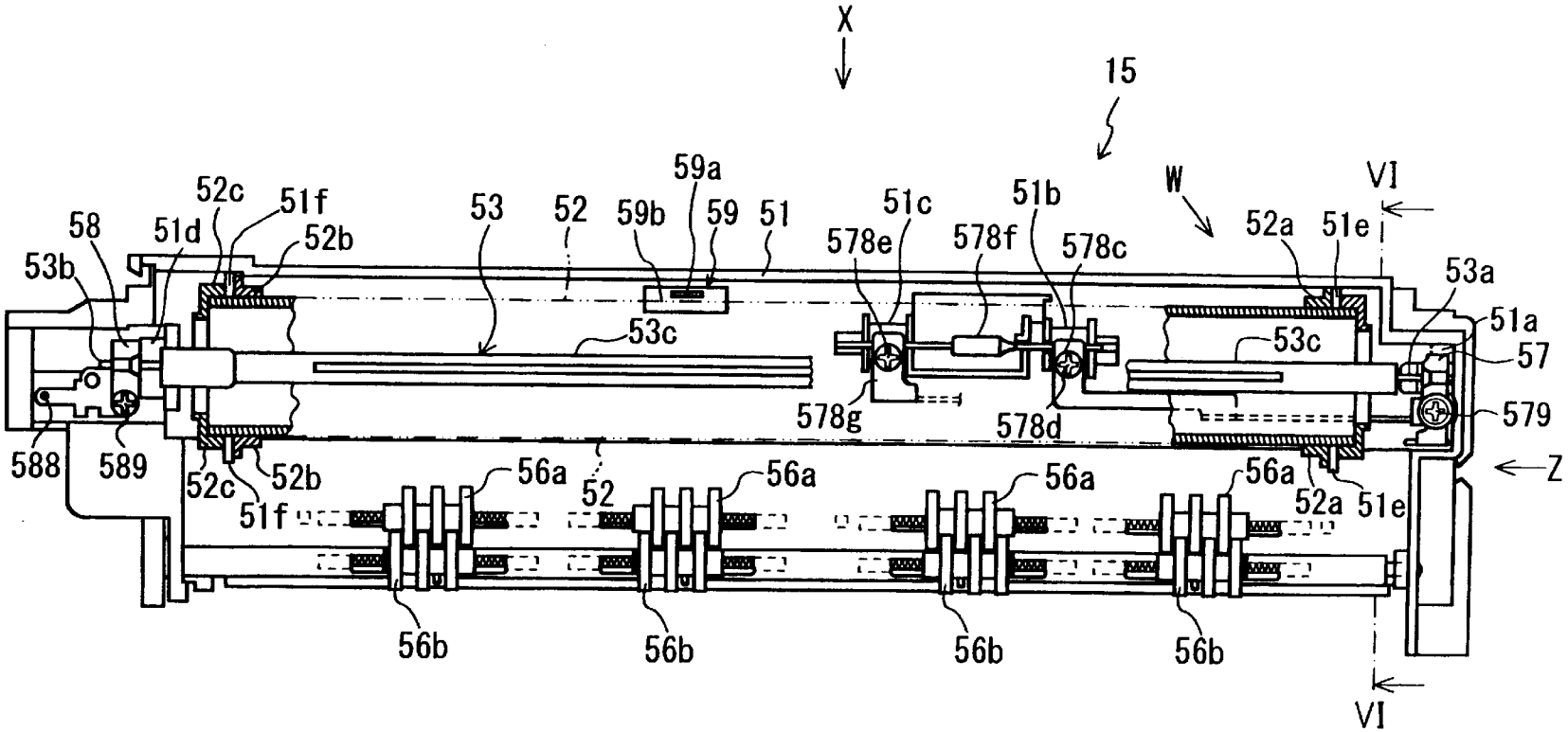
FIG. 5 is a schematic view of a fixing unit.
Figure 6:
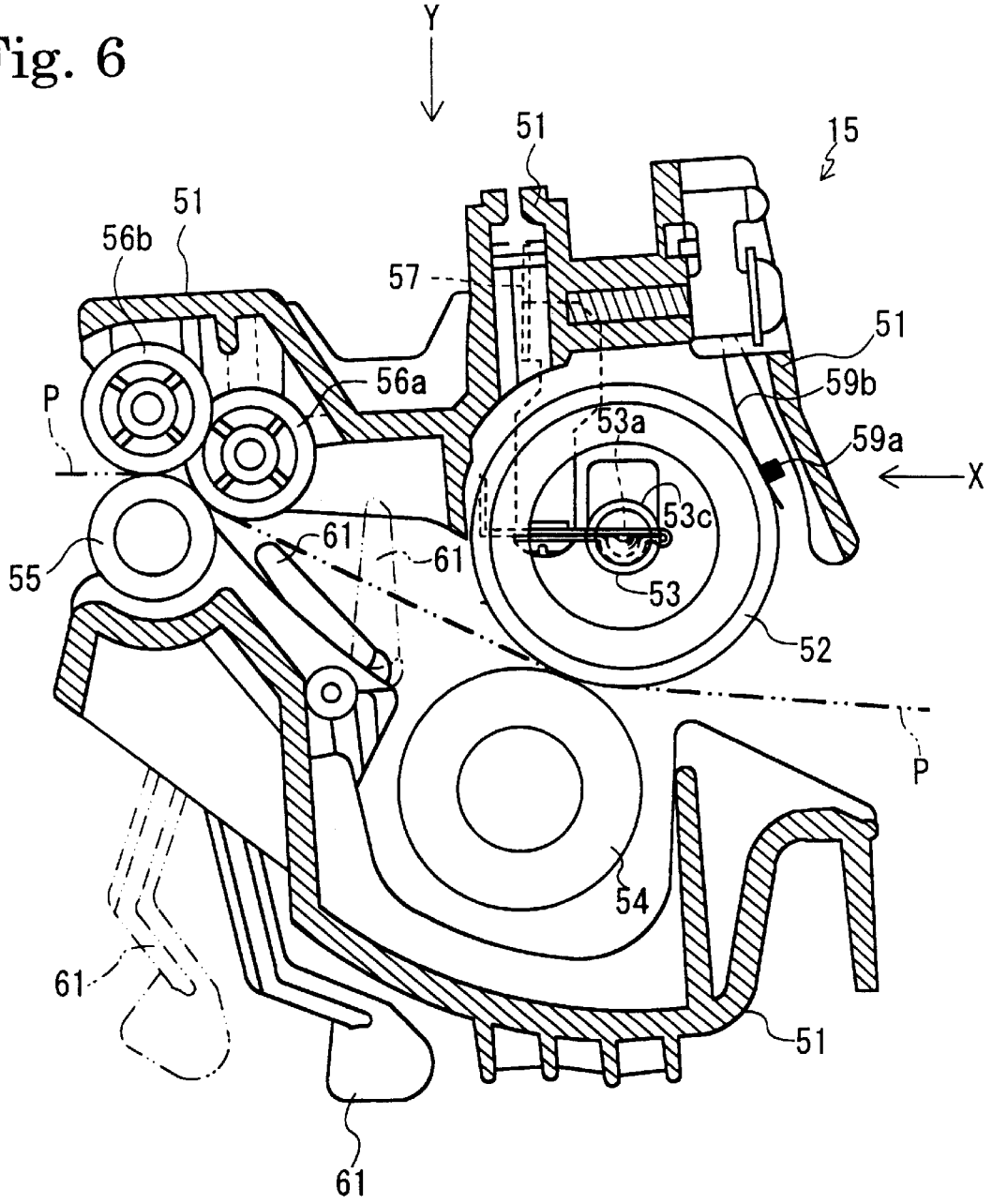
FIG. 6 is a sectional view taken along the line VI—VI of FIG. 5 as viewed from a direction opposite to the Z direction.

The fixing unit 15 will now be described in detail. FIG. 5 is a schematic view of the fixing unit 15, with the parts lower than the paper feed path omitted, as viewed from the bottom of FIG. 1 (from a direction opposite to the Y direction). FIG. 6 is a sectional view of the fixing unit 15 taken along the line VI—VI of FIG. 5 as viewed from the Z direction.

Component parts of the fixing unit 15 are disposed on a frame 51 and integrally mounted to the printer 1. As shown in FIG. 6, in the fixing unit 15, a heat roller 52 having a halogen heater 53, a pressure roller 54 urging the paper P to the heat roller 52, a first discharge roller 55 (FIG. 6) disposed downstream in the paper feed direction, first and second driven rollers 56*a*, 56*b* driven by the first discharge roller 55, and a paper discharge sensor 61, are integrally disposed on the frame 51.

The heat roller 52, as shown in FIG. 5 with parts omitted, extends substantially along the paper width in a direction (Z direction) perpendicular to the paper feed direction and is rotatably mounted at its opposite ends to frames 51*e*, 51*f* through bearings 52*a*, 52*b*. At this time, the surface of the heat roller 52 makes close contact with paper P. The heat roller 52 is a hollow cylinder made of aluminum-alloy and its outer surface is coated with fluororesin to prevent the toner T from adhering thereto when heated. A drive gear rotatably supported at its opposite ends by the bearings 52*a*, 52*b*, and driven by a motor (not shown) through a gear train, is abutted against a gear portion 52*c* provided at the Z-direction side end (on the left side of FIG. 5) of the heat roller 52, and rotates in the paper feed direction (clockwise in FIG. 6).

The halogen heater 53 is disposed along a central axis of the heat roller 52 and terminals 53*a*, 53*b*, provided at opposite ends of the halogen heater 53, are fixedly held by a movable power feeder 57 and a fixed power feeder 58, respectively. The halogen heater 53 is a halogen lamp formed by a quartz glass tube, as a body, having a tungsten filament (not shown) and filled with halogen gas. The halogen heater 53 can quickly heat its internal temperature to high temperatures when turned on. Due to the so-called halogen cycle, tungsten evaporated from the tungsten filament will return to the tungsten filament without adhering to the inside of the quartz glass tube. Consequently, blackening of the quartz glass is prevented and the amount of heat emitted will not be reduced. The filament will not become thin and thus will have a long service life. The halogen heater 53, when turned on, heats the heat roller 52 from the inside and raises the surface temperature thereof.

The pressure roller 54 is disposed so as to press the paper P transported to the heat roller 52 into contact with the same. The surface of the pressure roller 54 is made of heat-resistant silicon rubber and coated with fluororesin to prevent the toner T from adhering thereto. The pressure roller 54 is rotated by rotation of the heat roller 52. The pressure roller 54 is supported at its opposite ends by bearings urged by respective coil springs (not shown) toward the heat roller 52, and nips the paper P together with the heat roller 54.

As shown in FIG. 1, when the paper P is transported to the fixing unit 15, the pressure roller 54 urges and presses the paper P with a toner image formed thereon against the surface of the heat roller 52. At this time, since the surface of the heat roller 52 is at high temperatures, the toner T is melted to penetrate into fibers of the paper P. At this stage, the toner T is kept at relatively high temperatures and is not fully hardened. When the paper T is cooled by the outside air, the toner T is hardened and the toner image formed on the paper P is fully fixed.

Then the paper P is discharged from the fixing unit 15 by the first discharge roller 55, which is disposed downstream in the paper feed direction from the heat roller 52 and driven by a motor (not shown), and first driven rollers 56*a* and second driven rollers 56*b*, which are driven by the first discharge roller 55. A discharge direction switching unit 62 is disposed downstream in the paper feed direction from the first driven rollers 56*a* and the second driven rollers 56*b* of the fixing unit 15.

The discharge direction switching unit 62 has a guide rib 62*a* defining the curved paper feed path where the leading edge of the paper P is guided rearward (leftward in FIG. 1), upward, and then frontward of the printer I to the stacker 69. The guide rib 62*a* is journaled at its upper portion by a journal member 62*b*. The journal member 62*b* is restricted by a restricting member 62*d* so as to be movable only vertically and is urged downward by a wire spring 62*e*.

A torsion coil spring integrally formed with the wire spring 62*e* is also provided to the journal member 62*b* and urges the guide rib 62*a* to flip it up rearward (to the top left in FIG. 1). The guide rib 62*a*, when closed, is locked at its lower end by a nearby lock 63 provided on the main frame 11.

In the discharge direction switching unit 62 structured as described above, since the guild rib 62*a*, when locked by the lock 63, is urged downward by the wire spring 62*e*, the guide rib 62*a* is not released from its locked state and is not flipped up rearward by the coil spring. Thereby, the leading edge of the paper P discharged from the fixing unit 15 is guided by the guide rib 62*a* to the stacker 69. At the front of the stacker 69, an extension tray 68 is pivotally mounted so as to be extendible frontward.

On the other hand, when the guide rib 62*a* is flipped up by raising a finger piece 62*f*, the journal member 62*b* moves upward along the restringing member 62*d* against the urging force of the wire spring 62*e* and releases the guide rib 62*a* from the lock 63. Then, the guide rib 62*a* is flipped up rearward around the journal member 62*b* by the torsion coil spring. In this state, the paper P, discharged from the fixing unit 15 by the first discharge roller 55 and the driven rollers 56*a*, 56*b*, is discharged to the rear of the printer 1 without being transported to the guide rib 62*a*. At the rear of the printer, a paper discharge tray (not shown) is mounted so as to accommodate a stack of paper P.

As shown in FIG. 1, a control unit 20 is provided at the rear portion of the main frame 11. The control unit 20 comprises a CPU, a ROM, and a RAM. The control unit 20 controls input and processing of image data, emission from the laser diode 41, the polygon mirror drive motor 24, the transport unit 18, the halogen heater 53, the power source, and the entire system of the printer.

The movable power feeder 57 and the fixed power feeder 58 of the fixing unit 15 according to the invention will now be described in more detail.

As shown in FIG. 5, the movable power feeder 57 is disposed in a direction opposite to the Z direction (on the right side of FIG. 5) of the heat roller 52 of the fixing unit 15. As shown in FIG. 6, the movable power feeder 57 and the fixed power feeder 58 support the terminals 53*a*, 53*b* of the halogen heater 53 coaxially with the axis of the heat roller 52. For convenience in illustrating the structure, some parts including the bearings 52*a*, 53*b* and the gear portion 52*c* are omitted from FIG. 6.

Figure 7:
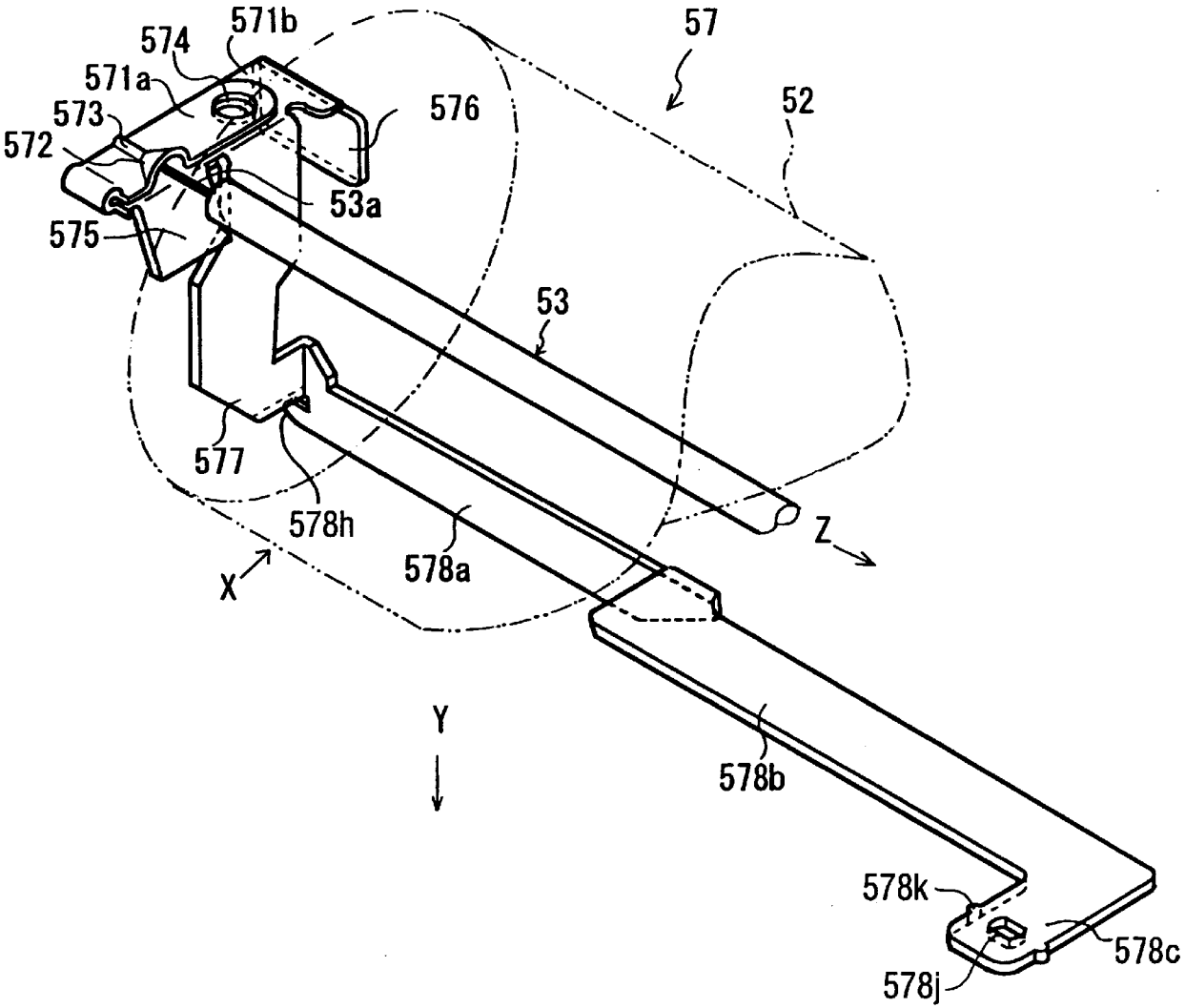
FIG. 7 is a perspective view of a movable power feeder 57 as viewed from the W direction of FIG. 5.
Figure 8:
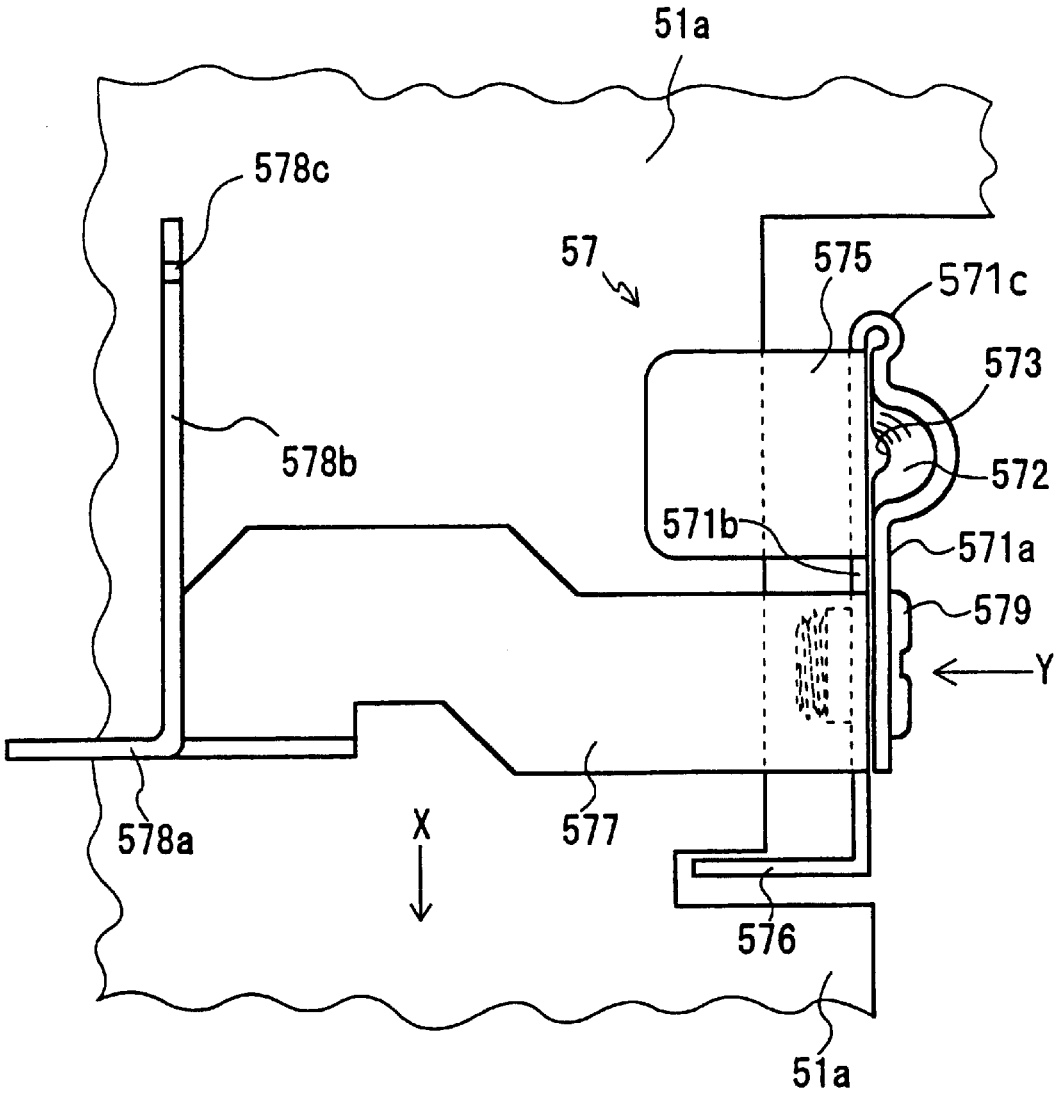
FIG. 8 shows the movable power feeder 57 as viewed from a direction opposite to the Z direction.

FIG. 7 is a perspective view of the movable power feeder 57 as viewed from the W direction of FIG. 5. FIG. 8 shows the movable power feeder 57 as viewed from a direction opposite to the Z direction, and FIG. 9 is a fragmentary view of the movable power feeder 57, with parts omitted, as viewed from the Y direction.

The movable power feeder 57 is formed by bending a thin plate having resilience and made of highly conductive metals, such as phosphor bonze or stainless steel. In this embodiment, phosphor bronze is used.

Referring to FIG. 8, the movable power feeder 57 will be described. The movable power feeder 57 is formed by laminating a first fastening plate 571*a* and a second fastening plate 571*b* such that the first fastening plate 571*a* is bent, at its X-direction side end, 180 degrees downwardly (to the Y direction) and continues into the second fastening plate 571*b*. A screw 579 is threaded into a screw hole 574. A comer 571*c* is curved at an appropriate radius to prevent clacking.

Figure 9:
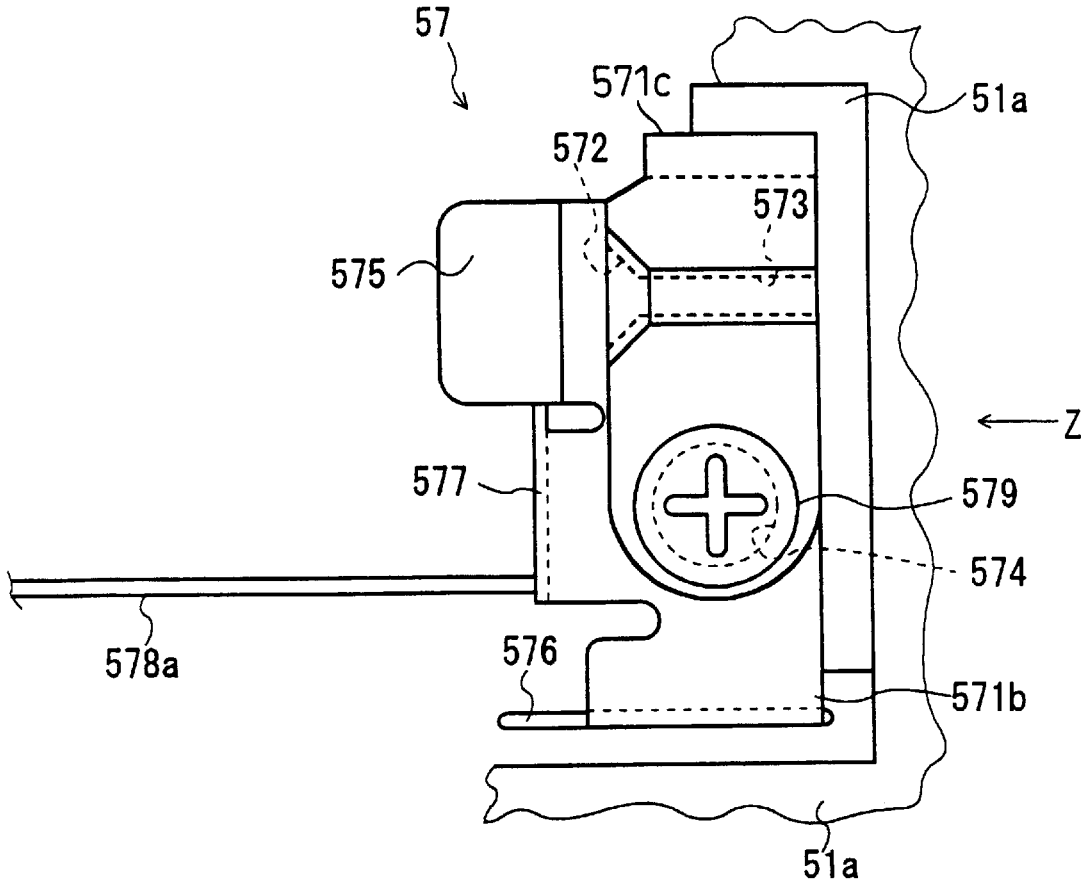
FIG. 9 is a fragmentary view of the movable power feeder 57, with parts omitted, as viewed from the Y direction.

As shown in FIGS. 7 to 9, an insertion guide 572, in the form of a semicircular hopper that is open on the Z-direction side, is provided on the side opposite to the X-direction of the first fastening plate 571*a*. The end of the terminal 53*a* is guided by the insertion guide 572 and inserted into a holding member 573. The holding member 573 communicates with the insertion guide 572 and has a semicircular tunnel-like space extending along the Z direction. The internal space defined by the holding member 573 is slightly smaller than the diameter of the terminal 53*a* of the halogen heater. The terminal 53*a* is fitted into this space and held by the holding member 573 and a surface of the second fastening plate 571*b*.

As shown in FIG. 8, the screw 579 is threaded into the screw hole 574 formed on the X-direction side through the first fastening plate 571*a* and the second fastening plate 571*b*. The screw 579 engages the screw hole 574 threaded in the second fastening plate 571*b*. Thereby, the first fastening plate 571*a* is pressed into contact with the second fastening plate 571*b* and the terminal 53*a* of the halogen heater 53 is firmly secured. Consequently, the first fastening plate 571*a*, the second fastening plate 571*b*, and the terminal 53*a* become reliably electrically conductive.

On the Y-direction side of the insertion guide 572, a rectangular apron guide 575 extends from the second fastening plate 571*b*.

As shown in FIGS. 8 and 9, a frame 51 a is provided in the vicinity of the movable power feeder 57, and a rectangular rotation stopper 576 extends toward the Y direction from the end opposite to the X direction of the second fastening plate 571*b*. The stopper 576 is placed along the nearby frame Sla and restricts the movement in the X direction of the first fastening plate 571*a* and the second fastening plate 571*b*. The frame 51*a* and the movable power feeder 57 are usually out of contact with each other.

As shown in FIG. 7, a supporting member 577 extends zonally toward the Y direction from the Z-direction side end near the fixing hole 574. The first fastening plate 571*a*, the second fastening plate 571*b*, the guide 575, and the rotation stopper 576 are out of contact with the frame 51 and supported only by the supporting member 577.

Figure 13:
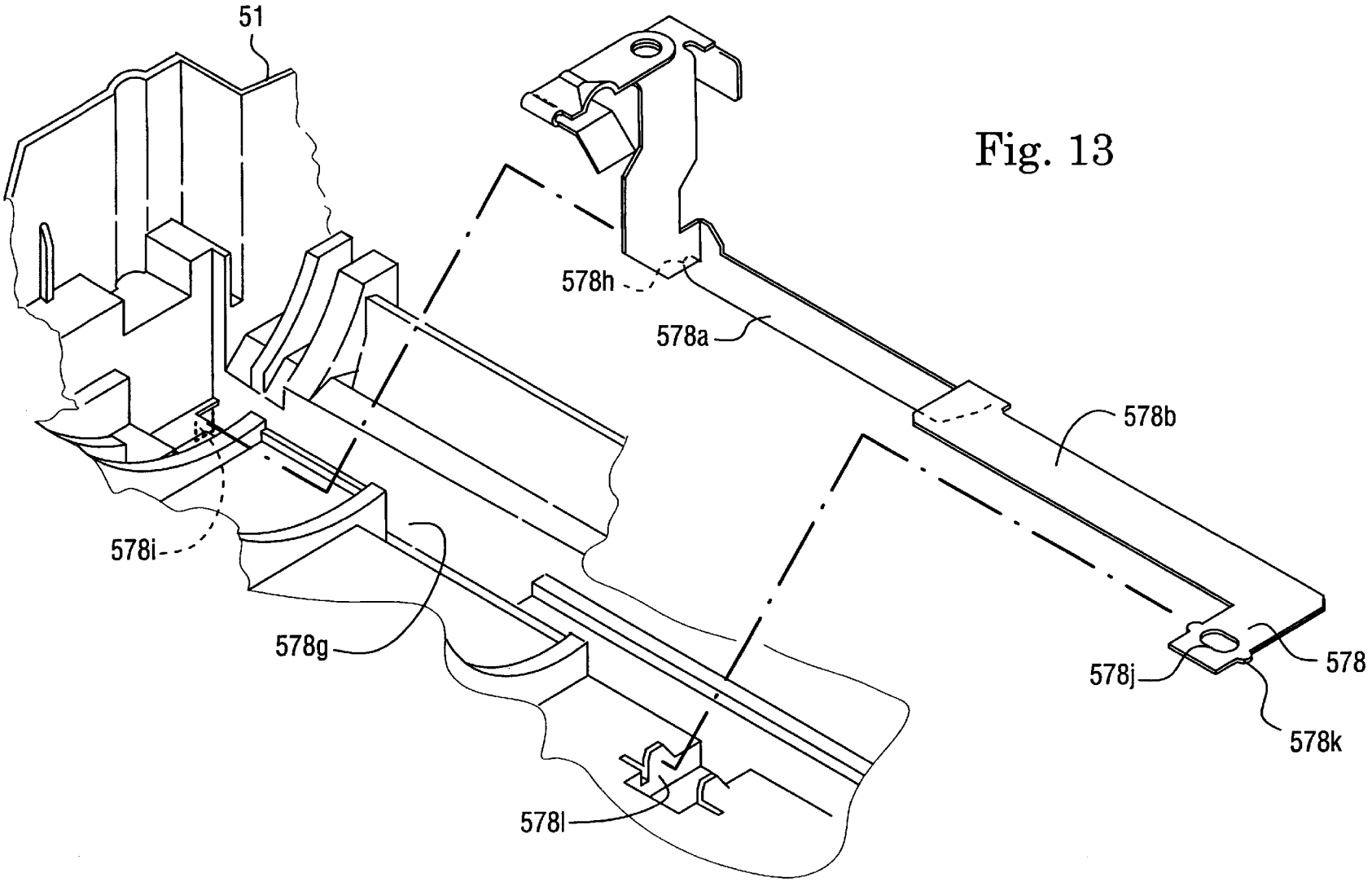
FIG. 13 is a perspective view showing the communication of the first conductive member 578*a*, second conductive member 578*b* and connecting member 578*c* with features of the frame 51.

As shown in FIGS. 7 and 13, a first conductive member 578*a* extends zonally from the Y-direction side end of the supporting member 577 toward the Z direction and perpendicularly to the Y direction while being fitted into a slot 578*g* of the frame 51. A projection 578*h* provided at the end opposite to the Z direction of the first conductive member 578*a* is fitted into a hole 578*i* provided in the frame 51, which limits movement of the first conductive member 578*a* in the Y direction. Further, a second conductive member 578*b* zonally extends from the Z-direction side end of the first conductive member 578*a* toward the Z direction and perpendicularly to the Y direction while being in contact with the frame 5 1. The conductive members 578*a*, 578*b* extend along the shape of the frame 51 and apart from the heat roller 52. In addition, a connecting member 578*c* is provided to be coplanar with the second conductive member 578*b* and to project from the Z-direction side end thereof toward the X direction. As shown in FIGS. 5 and 13, the connecting member 578*c* has a screw hole 578*j* in which a screw 578*d* is inserted for electrical connection to the power source. The connecting member 578*c* also has a pair of protrusions 578*k* that communicate with corresponding walls 5781 of the frame 51 to correctly position the connecting member 578*c* in the Z direction. When the screw 578*d* is threaded into the screw hole 578*j*, the projection 578*h* provided at the end of the first conductive member 578*a* is secured to the frame 51, and thereby the movable power feeder 57 is firmly secured to the frame 51.

In the movable power feeder 57 structured as described above, the first fastening plate 571*a*, the second fastening plate 571*b*, the guide 575, and the rotation stopper 576 are out of contact with the frame 51 and supported by the supporting member 577. On the other hand, since the supporting member 577 is made of a resilient material, the holding member 573 is shiftable in the Z direction due to its resilience. Thus, even when the terminal 53*a* moves in the Z direction, the holding member 573 shifts as the terminal 53*a* moves while firmly holding the terminal 53*a*.

As shown in FIG. 5, the terminal 53*b* on the left side (Z-direction side) of the halogen heater 53 is secured to the fixed power feeder 58.

Figure 10:
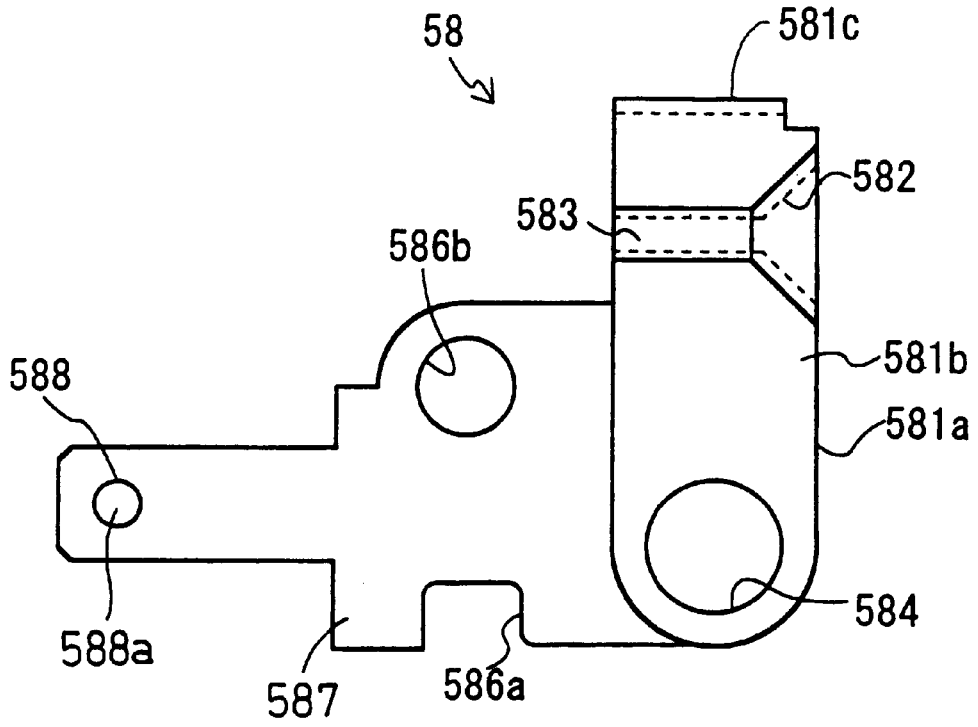
FIG. 10 shows a fixed power feeder 58 as viewed from a direction opposite to the Y direction.

FIG. 10 shows the fixed power feeder 58 as viewed from the Y direction. As shown in FIG. 10, the fixed power feeder 58 is formed by bending a thin plate made of highly conductive metals, such as phosphor bonze or stainless steel. In this embodiment, phosphor bronze is used.

As shown in FIG. 10, the fixed power feeder is formed by laminating a first fastening plate 581*a* and a second fastening plate 581*b* such that the first fastening plate 581*a* is bent 180 degrees downwardly (toward the Y direction) at its end opposite to the X direction and continues into the second fastening plate 581*b*. A screw 589 is threaded into a screw hole 574. A corner 581*c* is curved on an appropriate radius to prevent clacking.

As shown in FIG. 10, an insertion guide 582 in the form of a semicircular hopper, that is open on the side opposite to the Z-direction, is provided on the side opposite to the X-direction of the first fastening plate. The end of the terminal 53*b* is guided and inserted into a holding member 583. The holding member 583 communicates with the insertion guide 582 and has a semicircular space extending along the Z direction. The internal space defined by the holding member 583 is slightly smaller than the diameter of the terminal 53*b* of the halogen heater 53. As shown in FIG. 5, the terminal 53*b* penetrates this space and is held by the holding member 583 and a surface of the second fastening plate 581*b*.

As shown in FIG. 5, the fixed power feeder 58 is disposed on a frame 51*d*. A screw 589 passes through a screw hole 584 formed on the X-direction side through the first fastening plate 581*a* and the second fastening plate 581*b*, and is threaded into the frame 51*d*. By means of the screw 589, the fastening plates 581*a*, 581*b* are immovably secured to the frame 51 while the terminal 53*b* of the halogen heater 53 is firmly held. Consequently, the fastening plates 581*a*, 581*b* and the terminal 53*b* become electrically conductive.

As shown in FIG. 10, a plate 587 extends toward the Z direction from the first fastening plate 581*a* of the fixed power feeder 58. The plate 587 is provided with a boss hole 586*b* into which a boss (not shown) provided on the frame 51*d* is fitted. A notch 586*a* is also provided at the X-direction side end of the plate 587. The notch 586*a* and the boss hole 586*b* prevent the second fastening plate from rotating.

A connecting member 588 extends zonally from the plate 587 toward the Z direction. A cord (not shown) is soldered to an opening 588*a* formed at the tip of the connecting member to receive power from the power source.

As described above, the fixed power feeder 58 secures the terminal 53*b* of the halogen heater 53 to the frame 51*d* while firmly holding the terminal 53*b*, and thereby supports the halogen heater 53. Further, the power cord connected to the connecting member 588 ensures power supply to the halogen heater 53.

In the printer 1 according to the embodiment, the maximum paper width is approximately 210 mm, and the heat roller 52 and the halogen heater 53 have substantially the same length in the paper width direction as the maximum paper width. Since the linear thermal expansion coefficient of quartz glass is approximately $5.5\times10^{-7}$, the body 53*c* of the halogen heater 53, when turned on and heated, is elongated approximately 0.05 mm due to the thermal expansion.

At the same time, when the halogen heater 53 is turned on and heated, its surface temperature is raised and the heat roller is heated from the inside. The surface temperature of the heat roller 52 is raised to approximately 200° C. The surrounding frame 51 is also heated to 160° C. The frame 51 is made of dimensionally stable PET (polyethylene terephthalate). The linear thermal expansion coefficient of PET is approximately $2.0\times10^{-5}$. When the halogen heater 53 is heated, the distance between the movable power feeder 57 and the fixed power feeder 58 is elongated approximately 0.8 mm due to thermal expansion of the frame 51 (made of modified PPE (polyphenylene ether)).

In other words, thermal expansion causes a shift of approximately 0.8 mm between the halogen heater 53 and the frame 51 that supports the halogen heater 53. Thus, when the halogen heater 53 is immovably supported by the frame 51, as in the conventional case, quartz glass having low mechanical strength may break.

In the above-described embodiment, since the resilient supporting is member 577 absorbs mechanical strain, the halogen heater 53 is not affected or broken by the mechanical strain.

Further, since the terminals 53*a*, 53*b* of the halogen heater 53 are firmly held by the holding members 573, 583, respectively, even when the holding member 573 shifts in the Z direction, poor electric contact is not caused and stable power supply is reliably maintained.

A temperature fuse 578*f* will now be described. As shown in FIG. 5, the screw 578*d* passes through the screw hole in the connecting member 578*c* provided at the Z-direction side end of the movable power feeder 57 and is threaded into a fastening member 51*b*. The temperature fuse 578*f* is disposed on the Z-direction side (to the left in FIG. 5) of the fastening member 51*b* and in the vicinity of the surface of the heat roller 52. One terminal of the temperature fuse 578*f* is inserted to be sandwiched between the connecting member 578*c* and the fastening member 5 lb. The other terminal of the temperature fuse 578*f* is inserted to be sandwiched between a fastening member 51*c* and a fastening plate 578*g* made of phosphor bronze. A screw 578*e* passes through the fastening plate 578*g* and is threaded into the fastening member 51*c*, and thereby the other terminal is securely held. The other end of the temperature fuse 578*f* is wired through a hole (not shown) formed in the frame 51 to the back in FIG. 5 (in the Y direction) and connected to the power source (not shown).

As shown in FIG. 5, a temperature sensor 59 is disposed above (in a direction opposite to the X direction of) the central portion of the heat roller 52. The temperature sensor 59 includes a thermister 59*a* for detecting a temperature and a thermister support 59*b*. The thermister support 59*b*, made of heat-resistant resin, for example, a PI (polyimide) tape, is fixed at its one end to the frame 51 and supports and urges the thermister 59*a* so as to make sliding contact with the heat roller 52. The thermister 59*a* in sliding contact with the heat roller 52 measures the surface temperature of the heat roller 52 and sends a signal to the control unit 20 (FIG. 1). In response to the signal from the thermister 59*a*, the control unit 20 controls the surface temperature of the heat roller 52, when it is higher than a predetermined temperature, by turning off the halogen heater 53 or reducing output of the halogen heater 53.

Faulty temperature control by the thermister 59*a* and the control unit 20 may cause the heat roller 52 to overheat, resulting in a reduction in image quality and a deformation of the frame 51. When the heat roller 52 is in danger of overheating due to the faulty temperature control, the temperature fuse 578*f* interrupts power supply to the halogen heater 53 to prevent the heat roller 52 from overheating.

In the printer 1 according to the embodiment, the terminals 53*a*, 53*b* of the halogen heater 53 are fastened to the holding members 573, 583 by means of screws 579, 589, and the fixed power feeder 58 is firmly secured to the frame 51. Thereby, the halogen heater 53 is supported in a stable manner. Even when the halogen heater 53 is turned on and heats up rapidly and the frame 51 expands thermally, such expansion is absorbed by the supporting member 577. Thus, the halogen heater 53 will not be broken due to mechanical strain on the halogen heater.

Further, by use of the halogen lamp 53 having high thermal efficiency, quick thermal fixing can be achieved.

Further, since the terminals 53*a*, 53*b* are firmly fastened to the holding members 573, 583 of the movable power feeder 57 and the fixed power feeder 58, electric connections are reliably established. Accordingly, poor contact due to contaminated contact surfaces, insufficient urging force, and improper sliding due to biting is not caused by the difference in hardness of metals, ensuring stable power supply over an extended period of time.

Especially, the movable power feeder 57 is integrally formed by the holding member 573 on the first fastening plate 571*a* that holds the terminal 53*a* and serves as an electrode, the supporting member 577 that supports the first fastening plate 571 and the holding member 573, and a wiring member that includes the second fastening plate 571*b*, supporting member 577, first conductive member 578*a*, and second conductive member 578*b*. The movable power feeder 57 can be manufactured easily and at low cost by punching a plate out of a thin phosphor bronze sheet and bending the plate.

In the above-described embodiment, although only one terminal 53*a* of the halogen heater 53 is supported by the movable power feeder 57, the other terminal 53*b* may also be arranged in the same manner.

In addition, although the holding member 573 is integrally formed with the supporting member 577 that supports the holding member 573, they may be separately formed.

Figure 11:
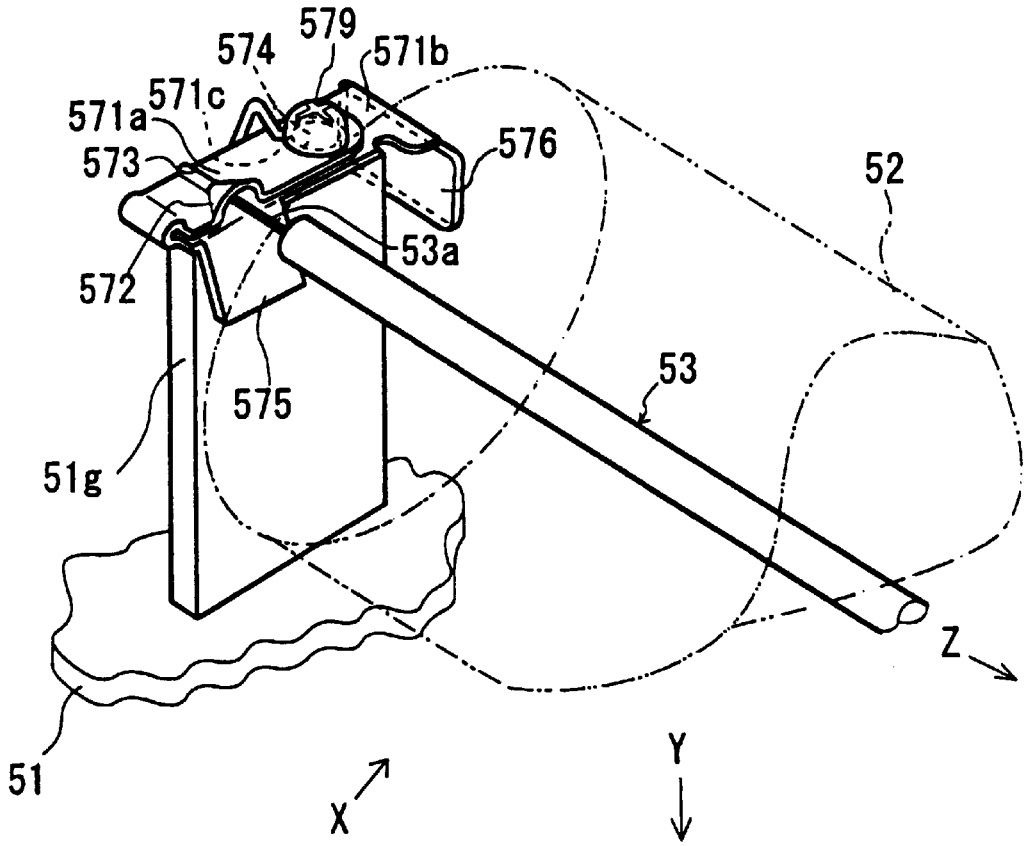
FIG. 11 shows a modified movable power feeder.
Figure 12:
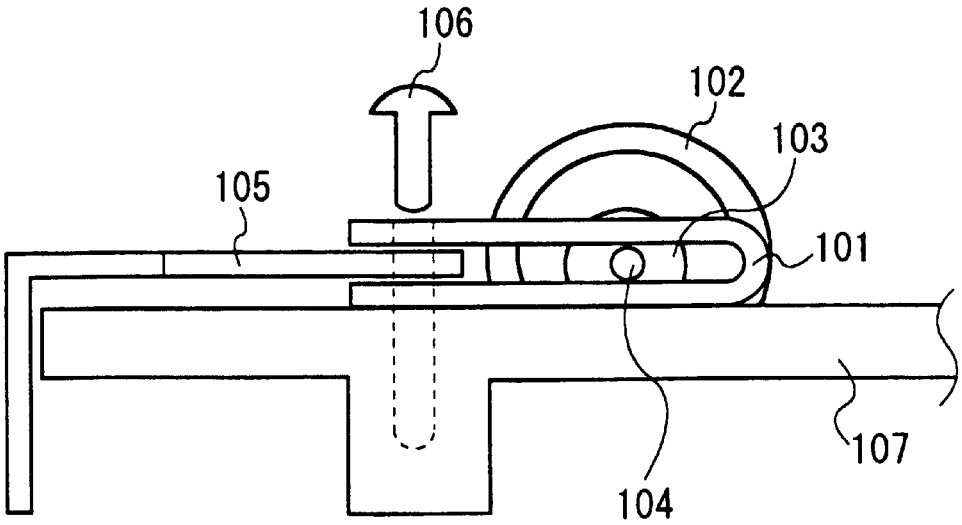
Fig. 12 PRIOR ART
FIG. 12 shows a conventional heater.

In this case, the supporting member 577 may be formed as part of the frame 51. As shown in FIG. 11, a supporting member 51 g is integrally molded with the frame 51 into a thin plate and makes the power feeder movable. The supporting member 51*g* has appropriate resilience so as to absorb strain and prevents a breakage of the halogen heater 53 when the frame 51 thermally expands. In this case, as the supporting member 51*g* is insulative, a fastening portion 571*c* is provided on the second fastening plate 571*b* and power is supplied to this portion using a flexible power cord. A ring-shaped terminal is soldered to the end of the flexible power cord. The screw 579 passes through the ring-shaped hole of the terminal and the screw hole 574 and is threaded into the supporting member 51*g*, and thereby electric connection is reliably established. With this arrangement, the same effects as obtained in the above-described embodiment can be obtained. The terminal 53*a* of the halogen heater 53 and the holding member 573 are electrically connected in a stable manner. At the same time, the halogen heater 53 is firmly supported by the frame 51, while its resilience is used to absorb mechanical strain on the halogen heater 53 and prevent breakage thereof.

The terminals 53*a*, 53*b* of the halogen heater 53 are not necessarily linear or pin-shaped. They may be tape-shaped, J-shaped, or looped. In such cases, the holding member 573 may be flat, or fastening screws may be used to fasten the J-shaped or looped portion. The holding member 573 may be of any shape that supports the terminal 53*a* of the halogen heater 53 and ensure reliable electric connection.

The heater may be, instead of the halogen heater 53, a glass tube supporting a Ni—Cr alloy or a ceramic heater. The invention can be applied to any type of heater that generates high heat, undergoes thermal expansion, and has low mechanical strength.

What is claimed is:

1. A thermal fixing device for use with a recording medium, comprising:

a heat roller that heats the recording medium;

a pressure roller disposed opposed to the heat roller that presses the recording medium into contact with the heat roller;

a frame that supports the heat roller and the pressure roller;

a heater disposed inside the heat roller and provided with terminals at opposite ends thereof that receive electric power;

electrodes fixed to the terminals of the heater and supplying the electric power to the heater, at least one of the electrodes not being directly fixed to the frame; and a supporting member disposed between the at least one of the electrodes and the frame that supports the at least one of the electrodes such that the at least one of the electrodes and one of the terminals fixed to the at least one of the electrodes can jointly shift while maintaining electric contact therebetween.

2. The fixing device according to claim 1, wherein the supporting member absorbs a difference in elongation between the heater and the frame caused, during heat generation by the heater, by a difference in linear expansion coefficient between the heater and the frame.

3. The fixing device according to claim 1, wherein the supporting member is made of a resilient material that can resiliently deform and shift.

4. The fixing device according to claim 1, wherein the supporting member is made of a resiliently deformable conductive material and is integrally formed with at least one of the electrodes.

5. The fixing device according to claim 1, wherein the supporting member is a supporting portion that is integrally formed with the frame and is resiliently deformable.

6. The fixing device according to claim 1, wherein the heater is a halogen heater that includes a quartz glass tube.

7. The fixing device according to claim 1, wherein the terminal is a pin-shaped terminal that has a rigidity capable of supporting a body of the heater.

8. The fixing device according to claim 1, wherein the supporting member deformably supports only one of the electrodes connected to one of the terminals of the heater, and the other electrode is secured to the frame.

9. A thermal fixing device for use with a recording medium, comprising:

a heat roller that heats the recording medium;

a pressure roller disposed opposed to the heat roller that presses the recording medium into contact with the heat roller;

a frame that supports the heat roller and the pressure roller;

a heater disposed inside the heat roller and provided with terminals at opposite ends thereof that receive electric power;

electrodes fixed to the terminals of the heater and supplying the electric power to the heater; and a supporting member disposed between at least one of the electrodes and the frame that supports the at least one of the electrodes such that the at least one of the electrodes can shift, the at least one of the electrodes including a first fastening plate and a second fastening plate that extend substantially parallel to each other.

10. The fixing device according to claim 9, wherein the first fastening plate and the second fastening plate are connected to each other by a curved portion.

11. The fixing device according to claim 10, wherein the first fastening plate, the second fastening plate and the curved portion are integrally formed and are laminated.

12. The fixing device according to claim 11, wherein the curved portion is curved at an appropriate radius to prevent cracking.

13. The fixing device according to claim 12, wherein the first fastening plate defines a holding member that holds the at least one of the terminals.

14. The fixing device according to claim 13, wherein the holding member defines a semicircular tunnel-like space that is slightly smaller than a diameter of the at least one of the terminals.

15. The fixing device according to claim 14, wherein the first fastening plate defines an insertion guide that guides the at least one of the terminals into the holding member.

16. The fixing device according to claim 15, wherein the insertion guide defines a semicircular hopper.

17. The fixing device according to claim 16, wherein the first fastening plate and the second fastening plate each define corresponding screw holes.

18. The fixing device according to claim 17, wherein the supporting member includes a screw insertable through the screw holes of the first fastening plate and the second fastening plate to press the first fastening plate, the second fastening plate and the at least one of the terminals into contact with each other.

19. The fixing device according to claim 18, wherein the supporting member includes a rectangular rotation stopper that extends perpendicular to a direction of extension of the first fastening plate and the second fastening plate, the rectangular rotation stopper restricting movement of the first fastening plate and the second fastening plate in the direction of extension of the first fastening plate and the second fastening plate.

20. The fixing device according to claim 19, wherein the supporting member includes a supporting element that extends perpendicular to the direction of extension of the first fastening plate and the second fastening plate and supports the first fastening plate, the second fastening plate and the rectangular rotation stopper.

21. An image forming apparatus, comprising:

an image forming unit that forms an image onto a recording medium; and the fixing device according to claim 1, wherein the fixing device makes the image on the recording medium permanent.

22. The image forming apparatus according to claim 21, wherein the image forming unit includes:

a photosensitive member;

an exposure unit that forms an electrostatic latent image on the photosensitive member;

a developing unit that supplies developer to the photosensitive member; and a transfer unit that transfers the developer on the photosensitive member to the recording medium.

* * * * *